US009474694B2

(12) United States Patent
Hartley

(10) Patent No.: US 9,474,694 B2
(45) Date of Patent: Oct. 25, 2016

(54) MEDICATION DISPENSING ASSEMBLY

(71) Applicant: Julian Perry Hartley, Fairhope, AL (US)

(72) Inventor: Julian Perry Hartley, Fairhope, AL (US)

( * ) Notice: Subject to any disclaimer, the term of this patent is extended or adjusted under 35 U.S.C. 154(b) by 97 days.

(21) Appl. No.: 14/504,574

(22) Filed: Oct. 2, 2014

(65) Prior Publication Data

US 2016/0095797 A1 Apr. 7, 2016

(51) Int. Cl.
*A61J 7/04* (2006.01)
*G08B 3/10* (2006.01)

(52) U.S. Cl.
CPC ..... *A61J 7/0409* (2013.01); *A61J 7/0481* (2013.01); *G08B 3/10* (2013.01); *A61J 2200/70* (2013.01); *A61J 2205/70* (2013.01)

(58) Field of Classification Search
CPC ..... A61J 7/00; A61J 7/04; A61J 7/0409; A61J 7/0427; A61J 7/0436; G06F 19/3462; G08B 21/24; B65D 51/248
See application file for complete search history.

(56) References Cited

U.S. PATENT DOCUMENTS 4,572,403 A 2/1986 Benaroya
4,809,877 A 3/1989 Albright
5,609,268 A 3/1997 Shaw
6,084,504 A * 7/2000 Rosche ..... A61J 7/0472 222/638
6,102,548 A * 8/2000 Mantle ..... A47G 29/1209 232/13
D619,350 S 7/2010 Leifeld et al.
8,269,613 B2 * 9/2012 Lazar ..... A61J 7/0481 340/309.16
2005/0151625 A1 * 7/2005 Lai ..... A61J 7/0409 340/309.16
2006/0220818 A1 * 10/2006 Trochesset ..... A61J 7/0472 340/457
2008/0114490 A1 * 5/2008 Jean-Pierre ..... G06F 19/3462 700/241
2008/0179387 A1 7/2008 Cantlay et al.
2009/0294521 A1 * 12/2009 de la Huerga ..... A61J 1/035 235/375
2010/0100237 A1 * 4/2010 Ratnakar ..... A61J 7/02 700/232
2012/0316405 A1 12/2012 Taylor
2013/0035785 A1 2/2013 MacVittie et al.
2013/0222135 A1 * 8/2013 Stein ..... A61J 7/0409 340/540

* cited by examiner

*Primary Examiner* — Andrew Bee

(57) ABSTRACT

A medication dispensing assembly includes a canister that has an outer wall extending between a top end and a bottom end of the canister. The top end of the canister is open so the canisters may contain a medication. A lid is coupled to the top end of the canister. A processor is coupled to the canister. A timer is coupled to the canister and the processor. The timer determines a trigger time that the medication is to be removed from the canister. An actuator is coupled to the canister and the processor. The actuator is actuated to determine the trigger time. An alarm is coupled to the canister and the processor. A sensor is coupled to the canister and the processor. The alarm continuously emits an audible alarm until the sensor detects that the lid is positioned in the open position.

7 Claims, 4 Drawing Sheets

MEDICATION DISPENSING ASSEMBLY

BACKGROUND OF THE DISCLOSURE

Field of the Disclosure

The disclosure relates to dispensing devices and more particularly pertains to a new dispensing device for providing an uninterrupted reminder to take medication.

SUMMARY OF THE DISCLOSURE

An embodiment of the disclosure meets the needs presented above by generally comprising a canister that has an outer wall extending between a top end and a bottom end of the canister. The top end of the canister is open so the canisters may contain a medication. A lid is coupled to the top end of the canister such that the lid selectively closes the top end of the canister. A processor is coupled to the canister. A timer is coupled to the canister. The timer is electrically coupled to the processor. The timer determines a trigger time that the medication is to be removed from the canister. An actuator is coupled to the canister. The actuator is electrically coupled to the processor. The actuator is actuated to determine the trigger time. An alarm is coupled to the canister. The alarm is electrically coupled to the processor. The alarm emits an audible alarm when the trigger time is reached. A sensor is coupled to the canister. The sensor is electrically coupled to the processor. The sensor engages the lid such that the sensor determines whether the lid is in an open position or a closed position. The alarm continuously emits the audible alarm until the sensor detects that the lid is positioned in the open position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
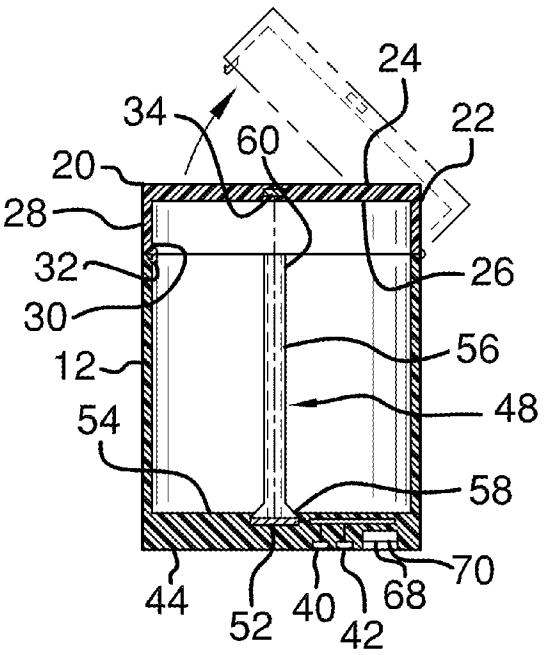
FIG. 2 is a cross sectional view taken along line 2-2 of FIG. 1 of an embodiment of the disclosure.
Figure 3:
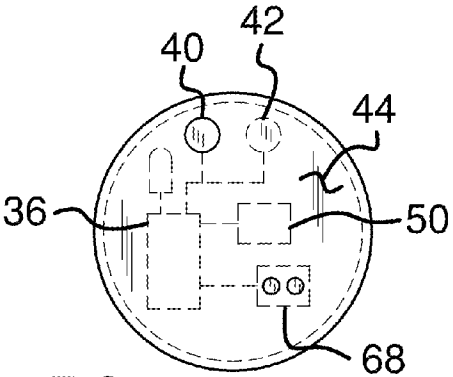
FIG. 3 is a bottom view of an embodiment of the disclosure.
Figure 1:
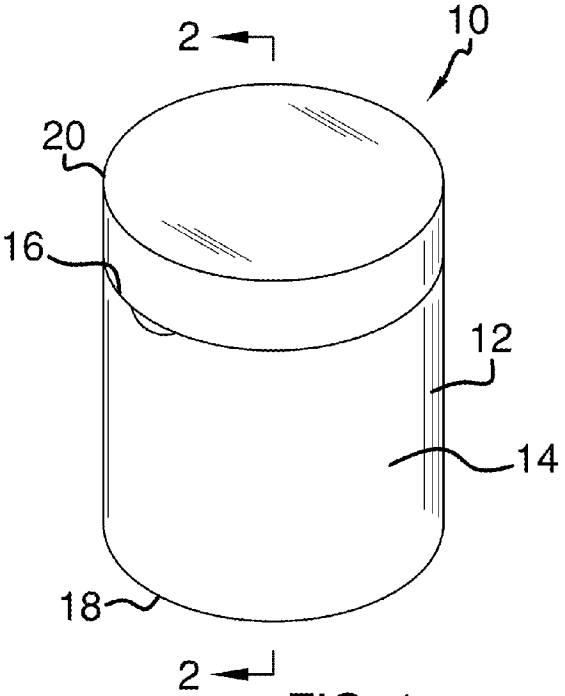
FIG. 1 is a perspective view of a medication dispensing assembly according to an embodiment of the disclosure.

With reference now to the drawings, and in particular to FIGS. 1 through 7 thereof, a new dispensing device embodying the principles and concepts of an embodiment of the disclosure and generally designated by the reference numeral 10 will be described.

As best illustrated in FIGS. 1 through 7, the medication dispensing assembly 10 generally comprises a canister 12. The canister 12 has an outer wall 14 extending between a top end 16 and a bottom end 18 of the canister 12. The top end 16 of the canister 12 is open such that the canister 12 may contain a medication 18. The medication 18 may be a medication in pill form.

A lid 20 is provided. The lid 20 has an outer edge 22 extending between a top side 24 and a bottom side 26 of the lid 20. Additionally, the lid 20 has a lip 28 coupled to and extending downwardly from the bottom side 26 of the lid 20. The lip 28 is coextensive with the outer edge 22 of the lid 20. The lip 28 is hingedly coupled to the top end 16 of the canister 12 such that the lid 20 selectively opens and closes the top end 16 of the canister 12.

A tab 30 is coupled to and extends downwardly from the lip 28. A free end 32 of the tab 30 engages the top end 16 of the canister 12 when the lid 20 is positioned in the closed position. The tab 30 retains the lid 20 in the closed position.

A first magnet 34 is provided. The first magnet 34 is coupled to the bottom side 26 of the lid 20. A processor 36 is coupled to the canister 12. A timer 38 is coupled to the canister 12. The timer 38 is electrically coupled to the processor 36. Moreover, the timer 38 determines a trigger time that the medication 18 is to be removed from the canister 12.

A pair of actuator 40,42 is coupled to a lower surface 44 of the bottom end 18 of the canister 12. The actuators 40,42 are electrically coupled to the processor 36. A first one of the actuators 40 is actuated to determine the trigger time. A second one of the actuators 42 is actuated to reset the trigger time.

An alarm 46 is coupled to the canister 12. The alarm 46 is electrically coupled to the processor 36. The alarm 46 emits an audible alarm when the trigger time is reached. A sensor 48 is coupled to the canister 12. The sensor 48 is electrically coupled to the processor 36. A vibrator 50 is coupled to the bottom end 18 of the canister 12. The vibrator 50 is electrically coupled to the processor 36. The vibrator 50 engages and vibrates the bottom end 18 of the canister 12 when the trigger time is reached.

The sensor 48 comprises a second magnet 52. The second magnet 52 is coupled to a top surface 54 of the bottom end 18 of the canister 12. The second magnet 52 may comprise a magnetic reed switch of any conventional design. The sensor 48 further comprises a tube 56.

The tube 56 is elongated between a lower end 58 and an upper end 60 of the tube 56. The upper 60 and lower 58 ends of the tube 56 are open. The tube 56 is substantially hollow. The lower end 58 of the tube 56 is coupled to the top surface 54 of the bottom end 18 of the canister 12 such that the lower end 58 of the tube 56 encompasses the second magnet 52. The tube 56 is centrally positioned within the canister 12.

The upper end 60 of the tube 56 engages the first magnet 34 when the lid 20 is positioned in the closed position. The first magnet 34 is placed in electromagnetic communication with the second magnet 52 such that the sensor 48 determines that the lid 20 is in the closed position. The first magnet 34 is removed from electromagnetic communication with the second magnet 52 when the lid 20 is positioned in the open position such that the sensor 48 determines that the lid 20 is in the open position. The alarm 46 continuously emits the audible alarm until the sensor 48 detects that the lid 20 is positioned in the open position.

A plurality of dividing walls 62 may each extend between the tube 56 and an inner surface 64 of the outer wall 14 of the canister 12. The dividing walls 62 may be evenly spaced apart and distributed around an entire circumference of the tube 56. The dividing wall 62 may define a plurality of medication spaces 66 within the canister 12.

A power supply 68 is coupled to the canister 12. The power supply 68 is electrically coupled to the processor 36. The power supply 68 comprises at least one battery 70.

Figures 4, 5:
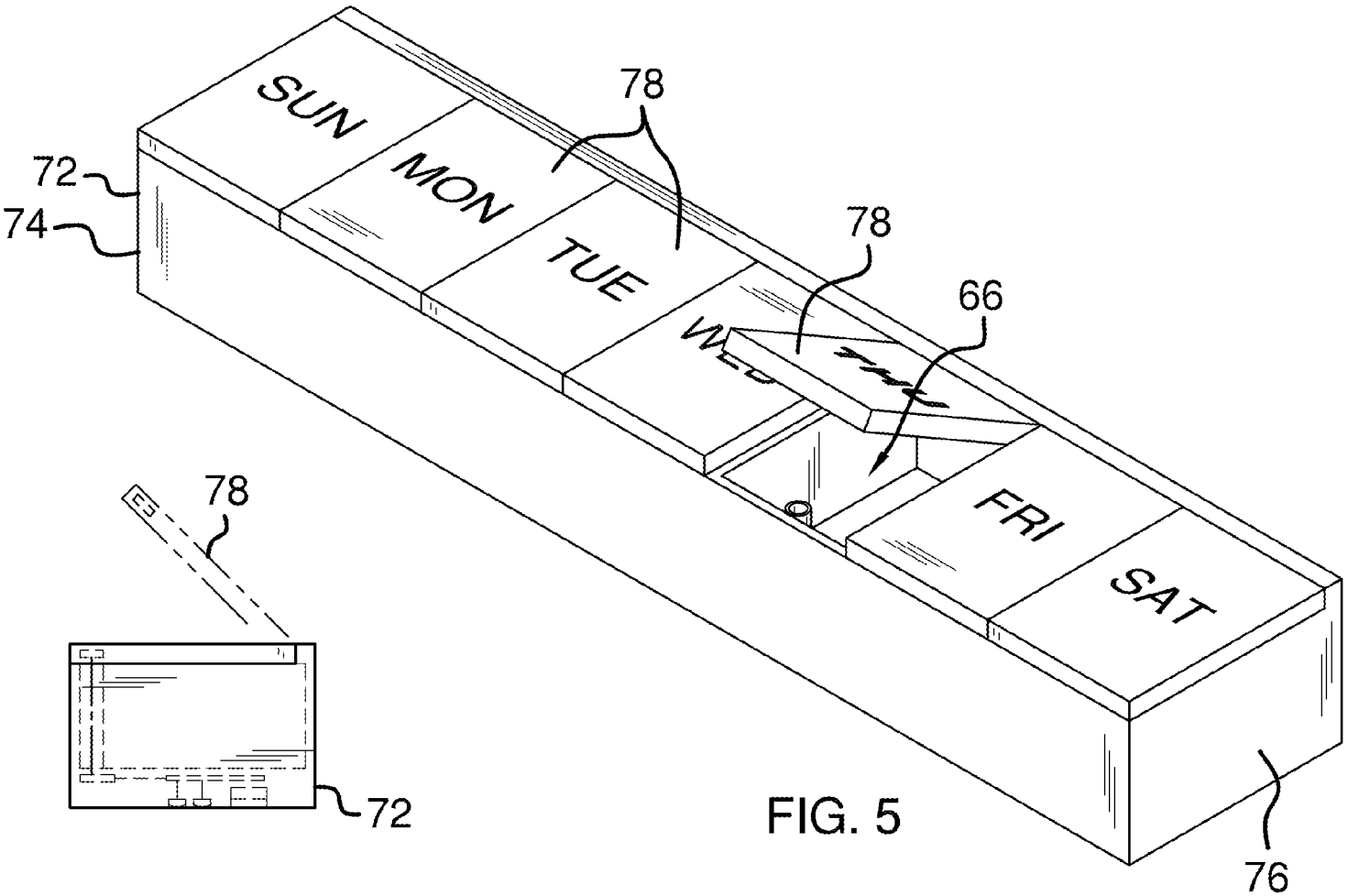
FIG. 4 is a side view of an alternative embodiment of the disclosure.
FIG. 5 is a perspective view of an alternative embodiment of the disclosure.
Figure 6:
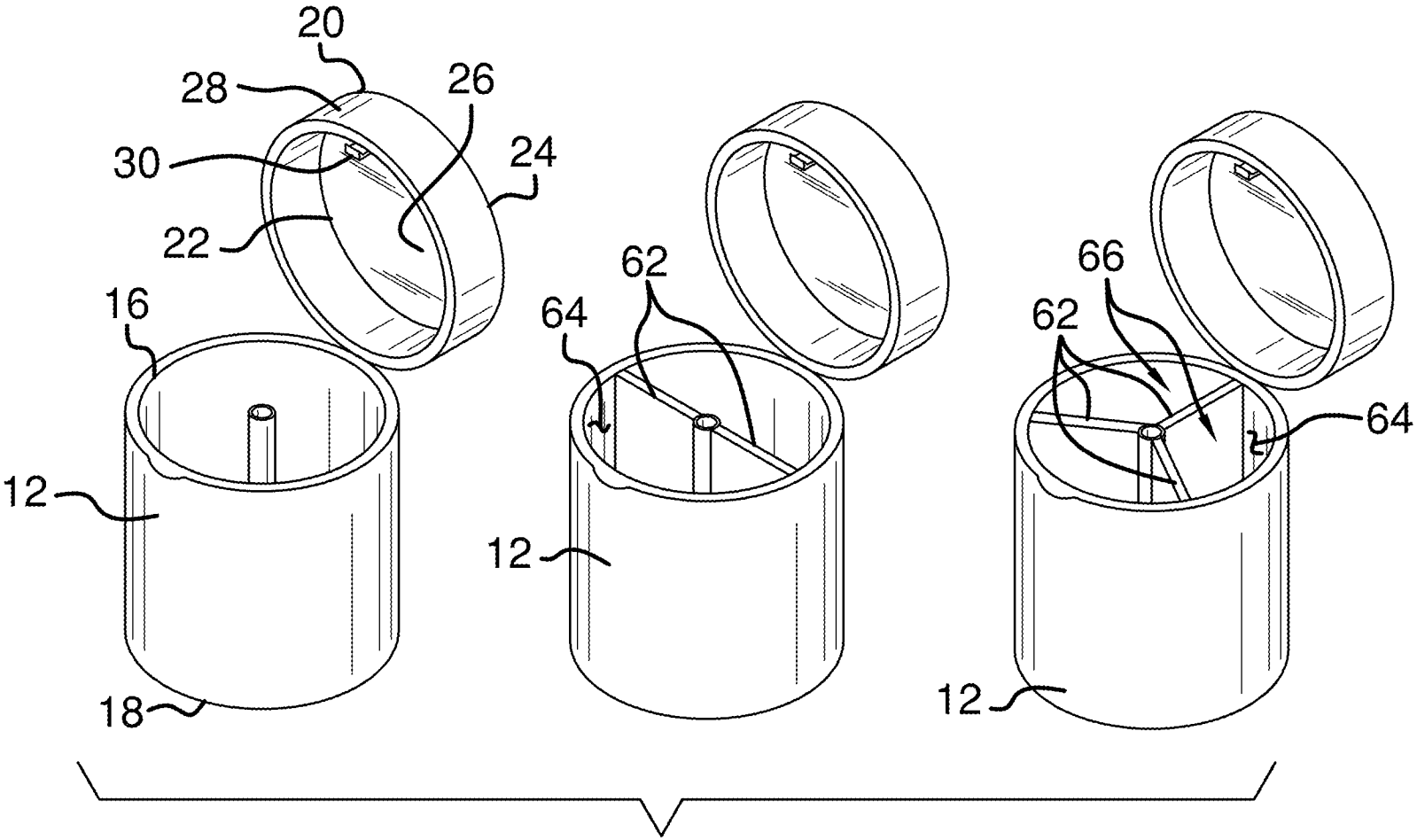
FIG. 6 is a top perspective view of an embodiment of the disclosure.
Figure 7:
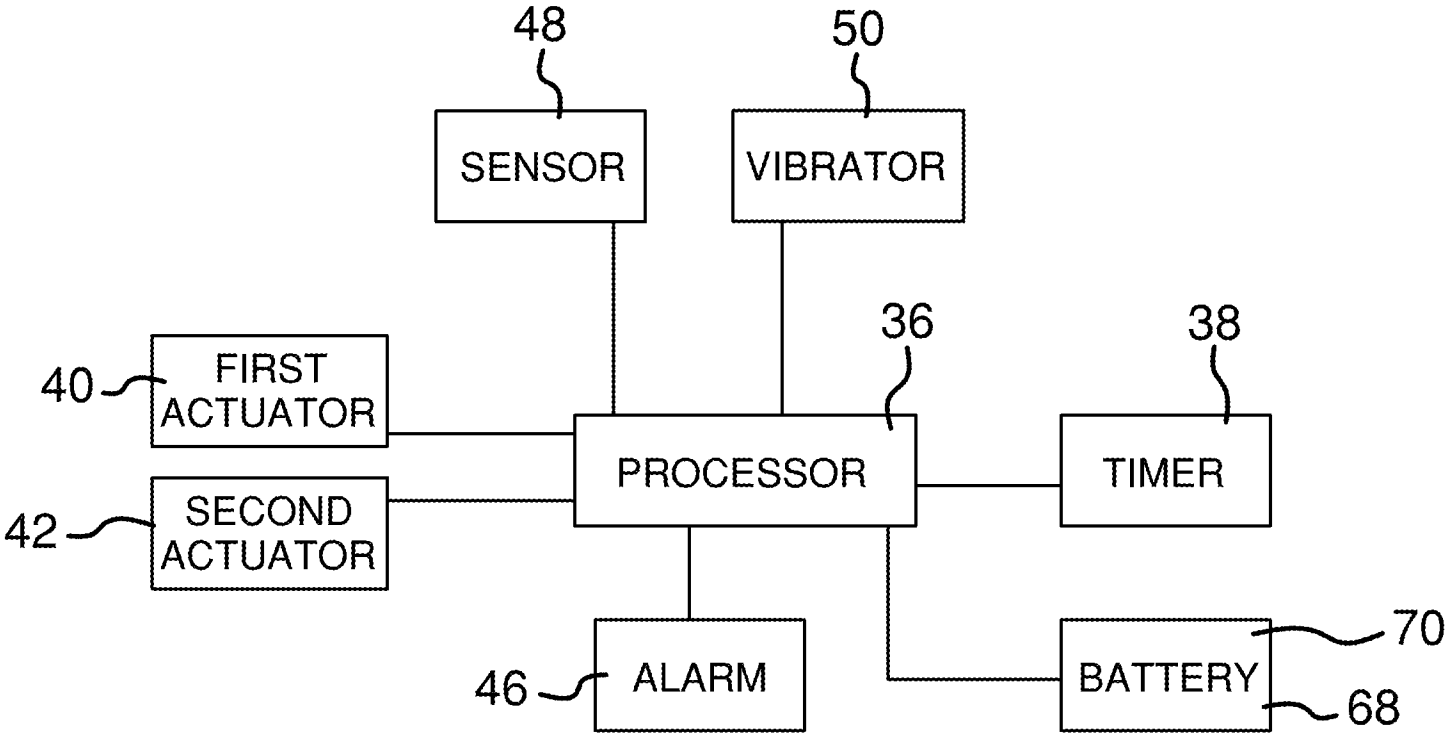
FIG. 7 is a schematic view of an embodiment of the disclosure.

In an alternative embodiment according to FIGS. 4 and 5, a housing 72 is provided. The housing 72 is elongated between a first end 74 and a second end 76 of the housing 72. An interior of the housing 72 is structured to define a plurality of medication spaces 66. A plurality of covers 78 is hingedly coupled to a top 80 of the housing 72. The covers 78 each selectively opens and closes an associated one of the medication spaces 66. A plurality of the sensors 48 is each positioned within an associated one of the medication spaces 66.

In use, the medication 18 is placed within the canister 12. The first actuator 40 is engaged to set the trigger time. The alarm 46 emits the audible alarm when the trigger time is reached. The lid 20 must be opened in order to cause the alarm 46 to cease emitting the audible alarm. The assembly 10 ensures that the medication 18 is removed from the canister 12 at the trigger time.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A medication dispensing assembly comprising:

a canister having an outer wall extending between a top end and a bottom end of said canister, said top end of said canister being open wherein said canister is configured to contain a medication;

a lid coupled to said top end of said canister such that said lid selectively closes said top end of said canister;

a processor coupled to said canister;

a timer coupled to said canister, said timer being electrically coupled to said processor, said timer determining a trigger time that the medication is to be removed from said canister;

an actuator coupled to said canister, said actuator being electrically coupled to said processor, said actuator being actuated to determine said trigger time;

an alarm coupled to said canister, said alarm being electrically coupled to said processor, said alarm emitting an audible alarm when said trigger time is reached;

a sensor coupled to said canister, said sensor being electrically coupled to said processor, said sensor engaging said lid such that said sensor determines whether said lid is in an open position or a closed position, said alarm continuously emitting said audible alarm until said sensor detects that said lid is positioned in said open position;

a first magnet coupled to said bottom side of said lid; and said sensor comprising a second magnet being coupled to a top surface of said bottom end of said canister.

2. The assembly according to claim 1, further comprising:

said lid having an outer edge extending between a top side and a bottom side of said lid; and said lid having a lip coupled to and extending downwardly from said bottom side of said lid such that said lip is coextensive with said outer edge of said lid.

3. The assembly according to claim 1, wherein said sensor further comprising a tube being elongated between a lower end and an upper end of said tube, said upper and lower ends of said tube being open, said tube being substantially hollow.

4. The assembly according to claim 3, further comprising said lower end of said tube being coupled to said top surface of said bottom end of said canister such that said lower end of said tube encompasses said second magnet.

5. The assembly according to claim 4, further comprising:

said upper end of said tube engaging said first magnet when said lid is positioned in a closed position such that said first magnet is in electromagnetic communication with said second magnet wherein said sensor determines that said lid is in said closed position; and said first magnet being removed from electromagnetic communication with said second magnet when said lid is positioned in said open position wherein said sensor determines that said lid is in said open position.

6. The assembly according to claim 1, further comprising a power supply coupled to said canister, said power supply being electrically coupled to said processor, said power supply comprising at least one battery.

7. A medication dispensing assembly comprising:

a canister having an outer wall extending between a top end and a bottom end of said canister, said top end of said canister being open wherein said canister is configured to contain a medication;

a lid, said lid having an outer edge extending between a top side and a bottom side of said lid, said lid having a lip coupled to and extending downwardly from said bottom side of said lid such that said lip is coextensive with said outer edge of said lid, said lip being hingedly coupled to said top end of said canister such that said lid selectively closes said top end of said canister;

a first magnet coupled to said bottom side of said lid;

a processor coupled to said canister;

a timer coupled to said canister, said timer being electrically coupled to said processor, said timer determining a trigger time that the medication is to be removed from said canister;

an actuator coupled to said canister, said actuator being electrically coupled to said processor, said actuator being actuated to determine said trigger time;

an alarm coupled to said canister, said alarm being electrically coupled to said processor, said alarm emitting an audible alarm when said trigger time is reached; and a sensor coupled to said canister, said sensor being electrically coupled to said processor, said sensor comprising;

a second magnet being coupled to a top surface of said bottom end of said canister, said sensor further comprising;

a tube being elongated between a lower end and an upper end of said tube, said upper and lower ends of said tube being open, said tube being substantially hollow, said lower end of said tube being coupled to said top surface of said bottom end of said canister such that said lower end of said tube encompasses said second magnet;

said upper end of said tube engaging said first magnet when said lid is positioned in a closed position such that said first magnet is in electromagnetic communication with said second magnet wherein said sensor determines that said lid is in said closed position, said first magnet being removed from electromagnetic communication with said second magnet when said lid is positioned in said open position wherein said sensor determines that said lid is in said open position, said alarm continuously emitting said audible alarm until said sensor detects that said lid is positioned in said open position; and a power supply coupled to said canister, said power supply being electrically coupled to said processor, said power supply comprising at least one battery.

* * * * *